US010827905B2

(12) United States Patent
Sankaran Veerabhagu et al.

(10) Patent No.: US 10,827,905 B2
(45) Date of Patent: Nov. 10, 2020

(54) DISHWASHER APPLIANCE WITH A VORTEX AIR DRYER

(71) Applicant: Haier US Appliance Solutions, Inc., Wilmington, DE (US)

(72) Inventors: Thiyagarajan Sankaran Veerabhagu, Mount Pleasant, MI (US); Ramasamy Thiyagarajan, Louisville, KY (US); Timothy Kopera, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 164 days.

(21) Appl. No.: 16/120,508

(22) Filed: Sep. 4, 2018

(65) Prior Publication Data

US 2020/0069147 A1 Mar. 5, 2020

(51) Int. Cl.
*A47L 15/48* (2006.01)
*A47L 15/42* (2006.01)

(52) U.S. Cl.
CPC ..... *A47L 15/486* (2013.01); *A47L 15/4246* (2013.01); *A47L 15/4257* (2013.01); *A47L 15/488* (2013.01); *A47L 2501/10* (2013.01); *A47L 2501/12* (2013.01)

(58) Field of Classification Search
CPC ..... A47L 15/486
See application file for complete search history.

(56) References Cited

U.S. PATENT DOCUMENTS 9,872,598 B2 1/2018 Thayyullathil et al.
2013/0008474 A1* 1/2013 Thayyullathil ..... A47L 15/488 134/95.2

FOREIGN PATENT DOCUMENTS

CN 205831748 U 12/2016
WO WO1998033427 A1 8/1998

* cited by examiner

*Primary Examiner* — Jason Y Ko
(74) *Attorney, Agent, or Firm* — Dority & Manning, P.A.

(57) ABSTRACT

A dishwasher appliance includes a tub that defines a wash chamber. A door is mounted to the tub for selectively accessing the wash chamber of the tub. A vortex air dryer has four vents and a fan. The four vents are positioned and oriented for forming a vortex air flow in the wash chamber during operation of the fan.

18 Claims, 3 Drawing Sheets

DISHWASHER APPLIANCE WITH A VORTEX AIR DRYER

FIELD OF THE INVENTION

The present subject matter relates generally to dishwasher appliances.

BACKGROUND OF THE INVENTION

Modern dishwashers typically include a wash chamber where detergent, water, and heat can be applied to clean food or other materials from dishes and other articles being washed. Various cycles may be part of the overall cleaning process. For example, a typical, user-selected cleaning option may include a wash cycle and rinse cycle (referred to collectively as a wet cycle), as well as a drying cycle. A pre-wash cycle may also be included as part of the wet cycle, and may be automatic or an option for particularly soiled dishes.

In one or more of these cycles, particularly during the drying cycle, it may be desirable to allow heated fluid—typically hot, humid air—to be vented from the wash chamber. Such venting allows for the removal of moisture from the dishes and helps dissipate heat from the drying cycle. Conventionally, one or more vents have been provided near the top of the front door of the dishwasher to allow for the escape of fluid from the wash chamber. The vents in known dryer appliances suffer drawbacks, including non-uniform air flow through the wash chamber.

BRIEF DESCRIPTION OF THE INVENTION

Aspects and advantages of the invention will be set forth in part in the following description, or may be apparent from the description, or may be learned through practice of the invention.

In a first example embodiment, a dishwasher appliance includes a tub that defines a wash chamber. The tub extends between a first side portion and a second side portion along a lateral direction. The tub also extends between a front portion and a rear portion along a transverse direction. The transverse direction is perpendicular to the lateral direction. A door is mounted to the tub at the front portion of the tub for selectively accessing the wash chamber of the tub. A vortex air dryer has four vents and a fan. A first one of the four vents is positioned at the first side portion and the rear portion of the tub. A second one of the four vents is positioned at the second side portion and the rear portion of the tub. A third one of the four vents is positioned at the second side portion and the front portion of the tub. A fourth one of the four vents is positioned at the first side portion and the front portion of the tub. The four vents are positioned and oriented for forming a vortex air flow in the wash chamber during operation of the fan.

In a second example embodiment, a dishwasher appliance includes a tub that defines a wash chamber. A door is mounted to the tub for selectively accessing the wash chamber of the tub. A vortex air dryer has four vents and a fan. Three of the four vents are positioned on the tub. One of the four vents is positioned on the door. The four vents are positioned and oriented for forming a vortex air flow in the wash chamber during operation of the fan.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
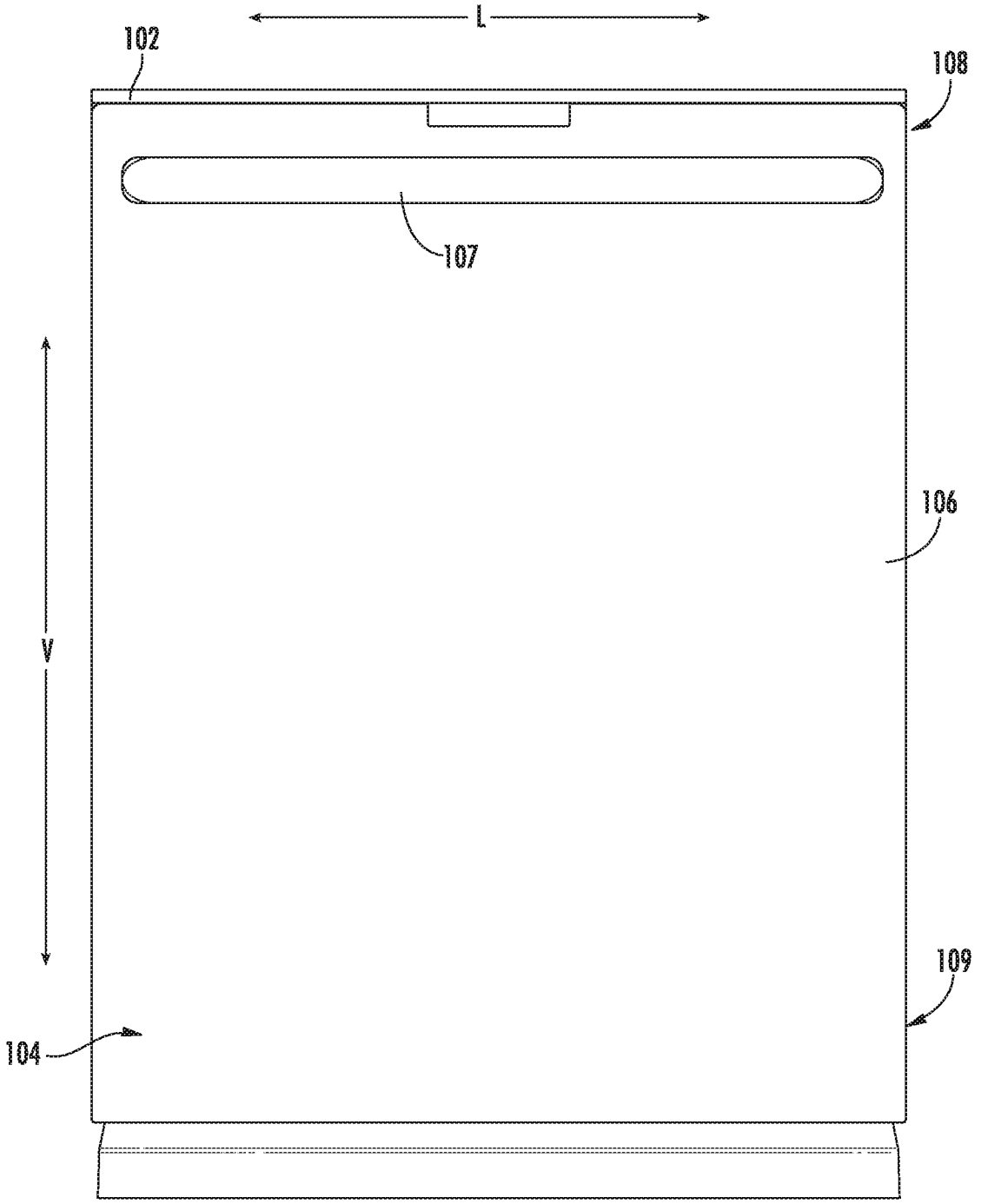
FIG. 1 is a front elevation view of a dishwasher appliance according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
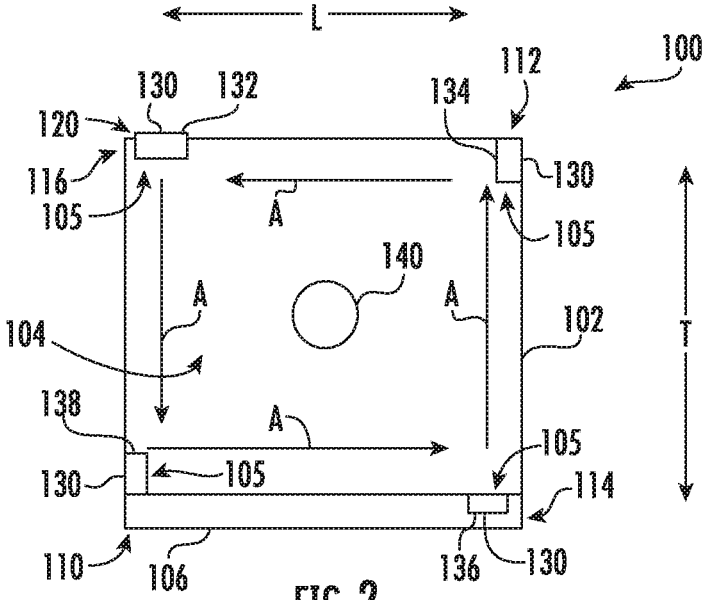
FIG. 2 is a schematic view of certain components of the example dishwasher appliance of FIG. 1.

FIGS. 1 and 2 depict an example domestic dishwasher appliance 100 that may be configured in accordance with aspects of the present disclosure. It should be appreciated that the invention is not limited to any particular style, model, or other configuration of dishwasher, and that the embodiment depicted in FIGS. 1 and 2 is for illustrative purposes only.

For the particular embodiment of FIG. 2, dishwasher appliance 100 includes a tub 102 that defines a wash chamber 104 within an interior of tub 102. Wash chamber 104 is configured for the receipt of articles for cleaning, such as dishes, cups, utensils, etc. Tub 102 includes a front opening (not shown) and a door 106 with a handle 107. Door 106 extends between a top portion 108 and a bottom portion 109 along a vertical direction V, and door 106 is hinged at or near bottom portion 109 of door 106 for movement between a normally closed vertical position (shown in FIGS. 1 and 2), wherein wash chamber 104 is sealed shut for washing operation, and a horizontal open position for loading and unloading of articles from wash chamber 104.

Dishwasher appliance 100 includes various components for applying wash fluid onto articles within wash chamber 104 and for supporting the articles within wash chamber 104. Such components are well known in the art and not shown or described in detail herein. As an example, dishwasher appliance 100 may include racks for supporting articles for washing within wash chamber 104, spray assemblies for directing flows of wash fluid onto the articles within the racks, silverware baskets, etc. The racks may be adapted for movement between an extended loading position in which the racks are substantially positioned outside wash chamber 104, and a retracted position in which the racks are located inside wash chamber 104. The spray assemblies may include rotatable spray arms mounted to tub 102 and/or one or the racks.

In general, dishwasher appliance 100 may utilize a variety of cycles to wash and, optionally, dry articles within wash chamber 104. For example, a wet cycle is utilized to wash articles. The wet cycle may include a main wash cycle and a rinse cycle, as well as an optional pre-wash cycle. During each such cycle, water or another suitable liquid may be utilized in wash chamber 104 to interact with and clean articles therein. The liquid may additionally mix with, for example, detergent or other various additives which are released into the chamber during various sub-cycles of the wet cycle. A drying cycle may be utilized to dry articles after washing. In generally, no liquid is sprayed or otherwise produced during the drying cycle.

During the drying cycle, liquid water on the articles within wash chamber 104 evaporates. The water vapor is flowable out of wash chamber 104 in order to improve drying performance of dishwasher appliance 100. Dishwasher appliance 100 includes various features for flowing air and water vapor from wash chamber 104, e.g., during drying cycles. Such features may improve performance of dishwasher appliance 100.

Turning to FIGS. 2 through 5, dishwasher appliance 100 includes a vortex air dryer 120. Vortex air dryer 120 is operable to generate a vortex air flow in wash chamber 104. The vortex air flow may have a generally circular shape, e.g., in a plane that is perpendicular to the vertical direction V, within wash chamber 104. In addition, the vortex air flow may flow around a vertical central axis of wash chamber 104 to assist with more uniformly drying articles within wash chamber 104 relative to known dishwasher appliances, e.g., with a single vent opening. Thus, the vortex air flow generated by vortex air dryer 120 may assist with drying articles more efficiently than known dishwasher appliances.

Figure 3:
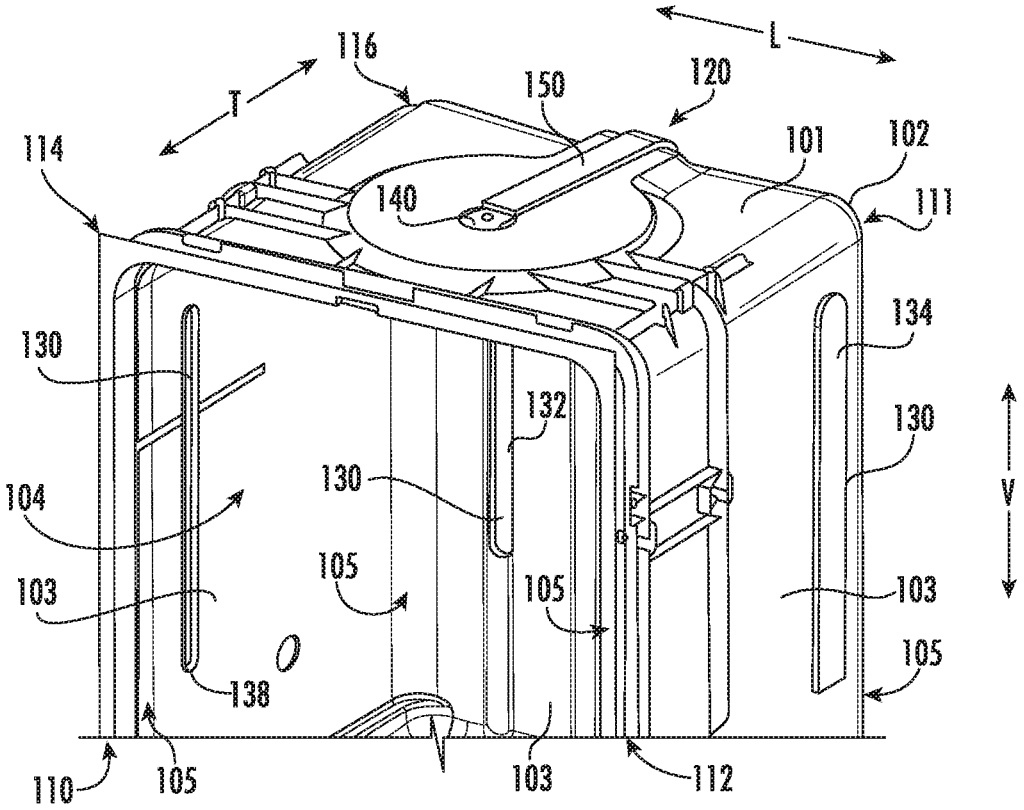
FIG. 3 is a partial perspective view of a tub of the example dishwasher appliance of FIG. 1.
Figure 5:
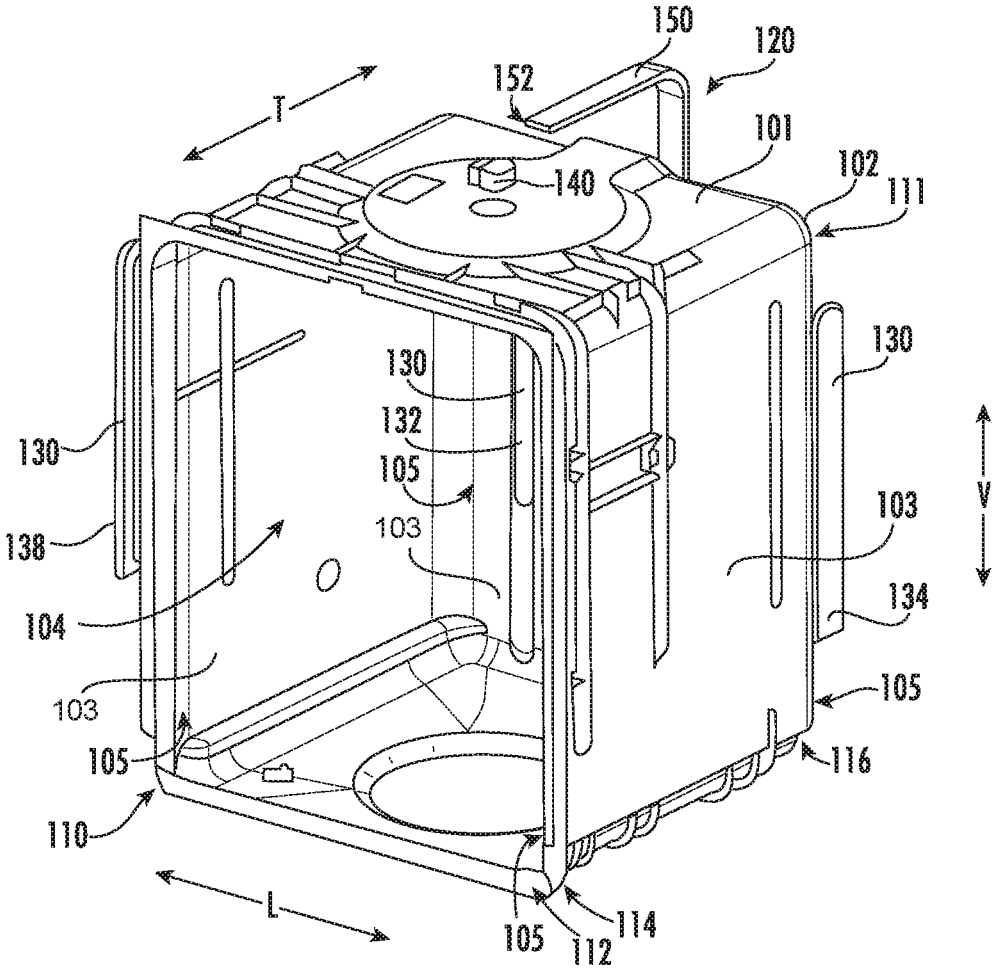
FIG. 5 is an exploded view of the tub of FIG. 3.

As may be seen in FIGS. 2, 3 and 5, tub 102 extends between a first side portion 110 and a second side portion 112, e.g., along a lateral direction L. Tub 104 may also extend between a front portion 114 and a rear portion 116, e.g., along a transverse direction T. The transverse direction T is perpendicular to the lateral direction L. In addition, the transverse direction T, the lateral direction L and the vertical direction V may be mutually perpendicular and form an orthogonal direction system.

Vortex air dryer 120 has four vents 130 and a fan 140. The four vents 130 are positioned and oriented for forming the vortex air flow in wash chamber 104 during operation of fan 140. As an example, a first one 132 of the four vents 130 may be positioned at first side portion 110 and rear portion 116 of tub 102, a second one 134 of the four vents 130 may be positioned at second side portion 112 and rear portion 116 of tub 102, a third one 136 of the four vents 130 may be positioned at second side portion 112 and front portion 114 of tub 102, and a fourth one 138 of the four vents 130 may be positioned at first side portion 110 and front portion 114 of tub 104.

In addition, three of the four vents 130 may be positioned on a respective side wall 103 of tub 102, and one of the four vents 130 may be positioned on door 106. In particular, tub 102 may have three side walls 103, e.g., that have a U-shaped cross-section in a plane that is perpendicular to the vertical direction V, and three of the four vents 130 may be positioned on a respective one of the three side walls 103 of tub 102. Each vent 130 may be oriented such that air from vent 130 flows generally perpendicular to side wall 103 adjacent vent 130, as shown with arrows A in FIG. 2.

Each of the four vents 130 may also be positioned at a respective corner 105 of wash chamber 104. In particular, wash chamber 104 may have a generally square or rectangular cross-section, e.g., in a plane that is perpendicular to the vertical direction V, and have four corners. Each of the four vents 130 may be positioned at a respective one of the four corners 105 of wash chamber 104. Further, three of the four vents 130 may be positioned on tub 102, and one of the four vents 130 may be positioned on door 106. For example, first vent 132, second vent 134 and fourth vent 138 may be positioned on tub 102, and third vent 136 may be positioned on door 106.

It will be understood that dishwasher appliance 100 may include less or more than four vents 130 in certain example embodiments. For example, dishwasher appliance 100 may include three, five or more vents 130 that collectively form the vortex air flow in wash chamber 104 during operation of fan 140.

Fan 140 may be positioned at a top portion 111 of tub 104. In particular, fan 140 may be positioned on a top wall 101 of tub 102. Thus, e.g., fan 140 may be positioned over the four vents 130, e.g., along the vertical direction V. Fan 140 may be a radial fan, an axial fan, etc. In alternative example embodiments, vortex air dryer 120 may include a plurality of fans 140, and each of the fans 140 may be positioned at a respective one of the four vents 130.

Vortex air dryer 120 may also include an outlet duct 150. Outlet duct 150 extends from wash chamber 104. Air within wash chamber 104 exits wash chamber 104 through outlet duct 150 during operation of fan 140. Thus, an inlet 152 of outlet duct 150 may be contiguous with wash chamber 104. In particular, inlet 52 of outlet duct 150 may be positioned at top wall 101 of tub 102, e.g., and/or at fan 140. Outlet duct 150 may vent to ambient air about tub 102. As an alternative, outlet duct 150 may be configured to recirculate air through wash chamber 104, as discussed in greater detail below.

Figure 4:
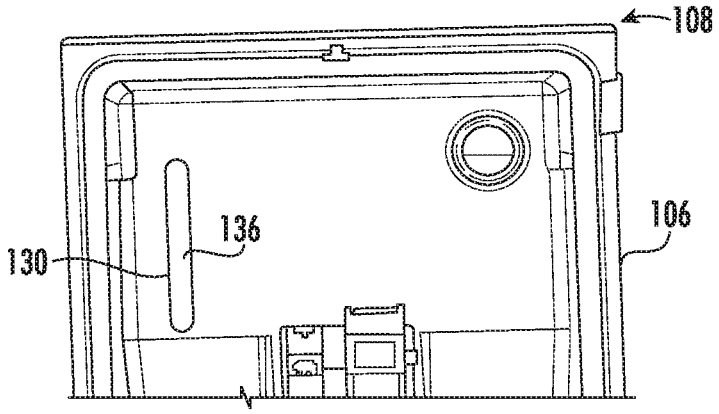
FIG. 4 is a partial, rear elevation view of a door of the example dishwasher appliance of FIG. 1.

In FIGS. 3 through 5, the four vents 130 are contiguous with ambient air about tub 102. Thus, e.g., the ambient air about tub 102 may flow into wash chamber 104 via the four vents 130, and vortex air dryer 120 may operate as an open system. In alternative example embodiments, the four vents 130 are contiguous with outlet duct 150, e.g., a respective outlet of outlet duct 150 may be positioned at each of the four vents 130. Thus, air within wash chamber 104 may recirculate via the four vents 130 and outlet duct 150, and vortex air dryer 120 may operate as a closed system. In such example embodiments, vortex air dryer 120 may include a sealed system of other drying device for condensing water vapor from air flowing through vortex air dryer 120.

As shown in FIGS. 3 through 5, the four vents 130 may be elongated along the vertical direction V. Thus, e.g., air flow into wash chamber 104 through the four vents 130 may be distributed along the vertical direction V. In certain example embodiments, a length of the four vents 130 along the vertical direction V may be no less than six inches (6"), no less than twelve inches (12") or no less than twenty-four inches (24"). It will be under stood that the longer that the four vents 130 extend along the vertical direction V, the distribution of the air flowing into wash chamber 104 through the four vents 130 may be advantageously distributed along the vertical direction V to assist with forming the vortex air flow in wash chamber 104.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance, comprising:

a tub defining a wash chamber, the tub extending between a first side portion and a second side portion along a lateral direction, the tub extending between a front portion and a rear portion along a transverse direction, the transverse direction being perpendicular to the lateral direction;

a door mounted to the tub at the front portion of the tub for selectively accessing the wash chamber of the tub; and a vortex air dryer having four vents and a fan, a first one of the four vents positioned at the first side portion and the rear portion of the tub, a second one of the four vents positioned at the second side portion and the rear portion of the tub, a third one of the four vents positioned at the second side portion and the front portion of the tub, a fourth one of the four vents positioned at the first side portion and the front portion of the tub, wherein the four vents are positioned and oriented for forming a vortex air flow in the wash chamber during operation of the fan.

2. The dishwasher appliance of claim 1, wherein three of the four vents are positioned on the tub, and one of the four vents is positioned on the door.

3. The dishwasher appliance of claim 1, wherein the fan is positioned at a top wall of the tub, three of the four vents are positioned on a respective side wall of the tub, and one of the four vents is positioned on the door.

4. The dishwasher appliance of claim 1, wherein the four vents are elongated along a vertical direction that is perpendicular to the lateral and transverse directions.

5. The dishwasher appliance of claim 1, wherein each of the four vents has a length along the vertical direction, the length of each of the four vents being no less than twelve inches.

6. The dishwasher appliance of claim 1, wherein the fan is a plurality of fans, and each of the plurality of fans is positioned at a respective one of the four vents.

7. The dishwasher appliance of claim 1, wherein the vortex air dryer further comprises an outlet duct, the outlet duct extending from the wash chamber, air within the wash chamber exiting the wash chamber through the outlet duct during operation of the fan.

8. The dishwasher appliance of claim 7, wherein the four vents are contiguous with ambient air about the tub.

9. The dishwasher appliance of claim 7, wherein the vortex air dryer is operable to recirculate air within the wash chamber through the four vents and the outlet duct.

10. A dishwasher appliance, comprising:

a tub defining a wash chamber;

a door mounted to the tub for selectively accessing the wash chamber of the tub; and a vortex air dryer having four vents and a fan, three of the four vents positioned on the tub, one of the four vents positioned on the door, wherein the four vents are positioned and oriented for forming a vortex air flow in the wash chamber during operation of the fan.

11. The dishwasher appliance of claim 10, wherein the fan is positioned at a top wall of the tub, and the three of the four vents are positioned on a respective side wall of the tub.

12. The dishwasher appliance of claim 10, wherein each of the four vents is positioned at a respective corner of the wash chamber.

13. The dishwasher appliance of claim 10, wherein the four vents are elongated along a vertical direction that is perpendicular to the lateral and transverse directions.

14. The dishwasher appliance of claim 13, wherein each of the four vents has a length along the vertical direction, the length of each of the four vents being no less than twelve inches.

15. The dishwasher appliance of claim 10, wherein the fan is a plurality of fans, and each of the plurality of fans is positioned at a respective one of the four vents.

16. The dishwasher appliance of claim 10, wherein the vortex air dryer further comprises an outlet duct, the outlet duct extending from the wash chamber, air within the wash chamber exiting the wash chamber through the outlet duct during operation of the fan.

17. The dishwasher appliance of claim 16, wherein the four vents are contiguous with ambient air about the tub.

18. The dishwasher appliance of claim 16, wherein the vortex air dryer is operable to recirculate air within the wash chamber through the four vents and the outlet duct.

* * * * *